US008616926B2

(12) United States Patent
Byrne

(10) Patent No.: US 8,616,926 B2
(45) Date of Patent: Dec. 31, 2013

(54) SOLID WIRE TERMINAL

(76) Inventor: Norman R. Byrne, Ada, MI (US)

( * ) Notice: Subject to any disclaimer, the term of this patent is extended or adjusted under 35 U.S.C. 154(b) by 0 days.

(21) Appl. No.: 13/323,091

(22) Filed: Dec. 12, 2011

(65) Prior Publication Data

US 2012/0083171 A1 Apr. 5, 2012

Related U.S. Application Data

(63) Continuation-in-part of application No. 12/857,822, filed on Aug. 17, 2010, now abandoned.

(60) Provisional application No. 61/234,412, filed on Aug. 17, 2009.

(51) Int. Cl.
*H01R 4/48* (2006.01)

(52) U.S. Cl.
USPC ..... 439/861; 439/862

(58) Field of Classification Search
USPC ..... 439/856, 857, 861, 862, 776
See application file for complete search history.

(56) References Cited

U.S. PATENT DOCUMENTS

| | | | | | |
|---|---|---|---|---|---|
| 1,477,527 | A * | 12/1923 | Raettig | 200/282 |
| 3,118,998 | A | 1/1964 | Mastney | |
| 3,162,501 | A * | 12/1964 | Wahl | 439/399 |
| 3,245,024 | A * | 4/1966 | Evans | 439/67 |
| 3,346,834 | A * | 10/1967 | Kinkaid | 439/723 |
| 3,955,869 | A * | 5/1976 | Licht | 439/218 |
| 4,175,821 | A * | 11/1979 | Hunter | 439/856 |
| 4,795,379 | A * | 1/1989 | Sasaki et al. | 439/856 |
| 4,932,906 | A * | 6/1990 | Kaley et al. | 439/857 |
| 4,990,110 | A * | 2/1991 | Byrne | 439/861 |
| 4,995,814 | A * | 2/1991 | Weidler | 439/61 |
| 5,024,610 | A * | 6/1991 | French et al. | 439/857 |
| 5,024,627 | A * | 6/1991 | Bennett et al. | 439/631 |
| 5,564,952 | A * | 10/1996 | Davis | 439/682 |
| 6,102,754 | A * | 8/2000 | Capper et al. | 439/857 |
| 6,383,039 | B1 * | 5/2002 | Yoneyama et al. | 439/856 |
| 6,402,571 | B1 * | 6/2002 | Muller et al. | 439/745 |
| 6,705,902 | B1 * | 3/2004 | Yi et al. | 439/678 |
| 6,776,635 | B2 * | 8/2004 | Blanchfield et al. | 439/181 |
| 6,932,660 | B2 * | 8/2005 | Roepke | 439/856 |
| 7,083,433 | B2 * | 8/2006 | Misawa et al. | 439/80 |
| 7,425,145 | B2 * | 9/2008 | Ngo | 439/290 |
| 7,726,982 | B2 * | 6/2010 | Ngo | 439/79 |
| 7,762,857 | B2 * | 7/2010 | Ngo et al. | 439/856 |
| 7,771,244 | B1 * | 8/2010 | Ju | 439/857 |
| 7,775,822 | B2 * | 8/2010 | Ngo et al. | 439/290 |
| 7,862,359 | B2 * | 1/2011 | Daily et al. | 439/290 |
| 7,892,050 | B2 * | 2/2011 | Pavlovic et al. | 439/839 |
| 7,905,731 | B2 * | 3/2011 | Ngo et al. | 439/75 |
| 7,967,648 | B2 * | 6/2011 | Byrne | 439/856 |
| 2002/0081916 | A1 * | 6/2002 | Wertz et al. | 439/856 |

(Continued)

*Primary Examiner* — Ross Gushi

(74) *Attorney, Agent, or Firm* — Gardner Linn, Burkhart & Flory, LLP

(57) ABSTRACT

A solid wire terminal (200) provides at least six locations of contact with respect to the electrical engagement of a conductive solid wire (232) with the solid wire terminal (200). The terminal (200) includes an electrical receptacle (202) having elongated upper arms (208) connected by an upper bridge (214), and elongated lower arms (216) connected by a lower bridge (222). The arms (208, 216) include half cylinder sections (224, 226) with inner surfaces (228, 230) which contact the conductive solid wire (232) when inserted between the upper bridge (214) and lower bridge (222). The solid wire terminal (200) is thus electrically connected to the conductive solid wire (232) along a longitudinal axis of the solid wire (232).

15 Claims, 6 Drawing Sheets

(56) References Cited

U.S. PATENT DOCUMENTS

| | | | | |
|---|---|---|---|---|
| 2005/0014423 | A1* | 1/2005 | Roepke | 439/856 |
| 2005/0042939 | A1* | 2/2005 | Wertz et al. | 439/857 |
| 2006/0003620 | A1* | 1/2006 | Daily et al. | 439/295 |
| 2010/0210152 | A1* | 8/2010 | Byrne | 439/856 |
| 2011/0039458 | A1* | 2/2011 | Byrne | 439/861 |
| 2012/0083171 | A1* | 4/2012 | Byrne | 439/888 |
| 2012/0231668 | A1* | 9/2012 | Byrne | 439/628 |

* cited by examiner

SOLID WIRE TERMINAL

CROSS-REFERENCE TO RELATED APPLICATIONS

This application is a continuation-in-part of U.S. patent application Ser. No. 12/857,822, filed Aug. 17, 2010, which claims priority of U.S. Provisional Patent Application Ser. No. 61/234,412, filed Aug. 17, 2009.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention relates generally to electrical terminals and, more particularly, to electrical terminals providing for electrical engagement of wire conductors.

2. Background Art

Historically, various types of assemblies have been developed for electrically and conductively interconnecting devices to be electrically energized to sources of electrical power. For example, it is well known to provide various spatial areas of residential, commercial and industrial establishments with electrical receptacle units permanently (through fuses, circuit breakers or other emergency shut-off elements) and conductively connected to one or more sources of main utility power. Each of the receptacle units typically comprises one or more engaging assemblies often referred to by the term "female receptacle."

These receptacle units are conventionally mounted in stationary walls or, alternatively, in the case of modern and modular office furniture systems, in moveable wall panels or even within work surfaces. Devices to be electrically energized often comprise receptacle plugs having two or more prongs or blade terminals adapted to be conductively engaged within the female receptacles. The prongs or blade terminals are conventionally referred to by the terms "male" plugs, prongs, blades or terminals. The receptacle plugs are typically interconnected to the circuitry of the device so as to be energized by wires extending through flexible insulative cords or the like. This type of male/female electrical interconnection configuration to provide removable or releasable conductive engagement is utilized in a myriad of electrical connector arrangements. For example, in addition to electrical energization of relatively large and discrete devices (such as lamps, televisions, stereos, typewriters, etc.), male/female interconnection configurations are also utilized internally in electrical devices such as computers and associated peripherals. In addition, male/female electrical interconnection arrangements are also utilized in a number of other applications, such as internal circuit wiring for electrical apparatus of modular office systems and the like.

In the design of male/female electrical interconnection configurations, it is of primary importance to provide a secure and stationary electrical contact between the conductive surfaces of the elements of the electrical receptacle and the conductive surfaces of the prongs or blade terminals. It is also of primary importance to provide surface connections having relatively little resistance. In view of the foregoing, various types of interfaces have been developed for engaging male prongs or blade terminals with mating female receptacles. For example, it is known to utilize an opposing pair of cantilever beams within the female receptacle, which provide a single point of contact on each side of an inserted male terminal. Other known arrangements include the use of single cantilever spring pressure, backed with a steel or similar spring supported within a plastic housing. This type of arrangement will conventionally provide a single point of contact at the electrical interface.

It has become known that it is preferable to provide as many interface points of contact as is reasonably possible, while still maintaining a releasable engagement. For example, an arrangement for providing four contact points is disclosed in Sasaki et al, U.S. Pat. No. 4,795,379 issued Jan. 3, 1989. The Sasaki et al patent refers to the concept that it has been known to utilize certain types of electrical connections in computers, telecommunications equipment and other data processing equipment, which are in the form of a receptacle contact having four resilient cantilever contact members extending forwardly from a base. The contact members are adapted to provide an electrical connection with a tab contact inserted from the front of the receptacle unit. The tab contact is electrically engaged by four leaves from four directions. The four leaves can be arranged as opposing pairs, with each pair arranged orthogonally.

In this type of arrangement, electrical engagement is made with the tab contact at four points, thereby increasing reliability of the receptacle contact relative to a contact arrangement having only two contact points. Sasaki et al also explains that a problem can arise in that a possibility of an incomplete electrical engagement can be caused by foreign matter on the surface of the tab contact. In addition, one of the pairs of contact members may engage the edge surfaces of the tab contact. The edge surfaces of the tab contact are typically the surface edges formed when the contact is made by stamping a sheet of conductive material. The surfaces are often rough in comparison with the planar rolled or formed surface of the sheet, and thus have a lower contact reliability. Accordingly, these contact members may not provide a reliable electrical connection, and a greater insertion force may be required at the time of insertion.

As an improvement, Sasaki et al describes a receptacle contact having opposed leaf spring members formed by two parallel plates linked through a U-shaped portion extending between adjacent sides of the leaf spring members. The leaf spring members include first spring arms and second spring arms formed integrally with the spring members.

The first spring arms and second spring arms are opposed to each other, and outer contact and inner contact members are formed at the free ends of the spring arms, which are also opposed to each other. Additional contact members are located to the rear of the first set of contact members. The spring arms extend side by side from the leaf spring members, with the outer contact members being slightly twice the width of the inner contact members. The contact members are arcuate to facilitate insertion of a tab contact there between.

The receptacle contact described in Sasaki et al is formed by stamping from a suitable metal sheet having the desirable conductive and spring characteristics. The stamping process is performed by shaping the metal sheet in an appropriate configuration, and then folding the spring arms to the shape required, while folding another portion into a U-shape. In use, the tip of a tab contact can be inserted into the space between the outer contact members opposed to each other at the front portion of the receptacle contact. Upon insertion, upper and lower surfaces of the contact are brought into a wiping engagement with the outer contact members. Accordingly, foreign matter on upper and lower surfaces of the contact is removed. When the contact is inserted further, the upper and lower surfaces which have been cleaned by the outer contact members are also wipingly engaged by the inner contact members. In this manner, a relatively greater electrical connection reliability between the tab contact and the inner contact members is provided. In addition, the outer contact members and inner contact members are in electrical engagement with upper and lower planar surfaces of the tab contact, and not with side surfaces which may comprise the cut edge surfaces of the contact. Accordingly, this decreases the force needed to insert the contact into the receptacle contact, thereby improving reliability of electrical connection.

In addition, the length of the spring arms, which provide the contact force created between the outer contact members and the tab contact, is longer than the length of the spring arms which provide the contact force between inner contact members and the tab contact. Accordingly, the insertion force is reduced by reducing the contact force created between the tab contact and the outer contact members, which clean the upper and lower surfaces of the tab contact. In this manner, the initial insertion force of the tab contact within the outer contact members is less than the insertion force of the inner contact members.

The foregoing background description primarily discusses issues associated with electrical terminals having means for conductively engaging components such as male blade terminals, prongs and the like. One difficulty which arises with respect to the electrical industry relates to situations where it is desirable to provide for electrical engagement along a solid wire or similar component. In the past, such interconnections have been made at the ends of solid wires, which may not provide for terminal connections in appropriate locations. Otherwise, to provide for electrical engagement at a location intermediate the ends of a solid wire, it has been known to utilize splicing or other means which require a "cutting off" of solid wire continuity, so as to engage with a terminal. Such activities can lessen the quality and integrity of electrical conductivity through the solid wire, particularly at connection junctions between cut solid wire and terminal elements. Also, such splicing or similar activities, along with the requirement to provide electrical terminals having a substantial metallic content, can add substantial expense with respect to labor for assembly and material content. Accordingly, it would be advantageous to provide for conductive electrical terminal contact at intermediate locations along a solid wire, without requiring continuity of the wire being disrupted.

SUMMARY OF THE INVENTION

In accordance with the invention, a solid wire terminal is adapted to conductively engage a conductive solid wire. The terminal includes an electrical receptacle having means for conductively coupling the receptacle to the wire. The coupling occurs at a series of contact locations between the receptacle and the conductive solid wire. The means for conductively coupling provides for conductive contact with the wire at a continuum of positions along a longitudinal axis of the wire, and without requiring splicing or similar structural modifications.

The electrical receptacle includes upper means extending forwardly, with surfaces having at least three contact locations formed thereon. Lower means extend forwardly and are conductively interconnected to and positioned below the upper means, and have upwardly directed surfaces with at least three lower contact locations. The receptacle is sized and configured so that the conductive solid wire is insertable between the upper means and the lower means, and is adapted to contact the receptacle at least three contact locations with the upper means and at least three contact locations with the lower means. The upper means includes a pair of lateral and parallel elongated upper arms extending forwardly. The upper arms include a first upper arm and second upper arm. An upper bridge is positioned transversely across forward portions of the upper arms. Each of the upper arms includes an upper arm half cylinder section with a curved shape having a downwardly facing concave configuration. The upper bridge and the upper arms form an upper arcuate spatial area. The upper means also includes an upper cantilever member positioned within the upper arcuate spatial area, and having a shape forming a first upper contact location having a contact surface thereon. Further, each of the upper arm half cylinder sections includes an upper arm half cylinder section inner surface. When the wire is inserted into the receptacle, the inner surfaces form second and third upper contact locations between the receptacle and the wire.

The lower means can include a pair of lateral and parallel elongated lower arms extending forwardly. A lower bridge is positioned transversely across forward portions of the lower arms. The lower arms and the lower bridge form a lower arcuate spatial area. An inner and lower cantilever member is positioned substantially within the lower arcuate spatial area and has a shape forming a first lower contact location between the inner lower cantilever member and the conductive wire.

Each of the lower arms includes a lower arm half cylinder section with a curved configuration directly opposing corresponding ones of the upper arm half cylinder sections. The lower arm half cylinder sections include upwardly facing concave configurations. Each of the lower arm half cylinder sections includes a lower arm half cylinder section inner surface. When the wire is received within the receptacle, these inner surfaces provide second and third contact locations between the lower arm half cylinder sections and the wire. Each of the first, second and third lower contact locations is positioned directly below each of the first, second and third upper contact locations.

The upper arm half cylinder sections and lower arm half cylinder sections are sized and configured, and sufficiently flexible and resilient, so as to be appropriately flexed when the conductive wire is releasably received or inserted between the upper half cylinder sections and lower half cylinder sections. Also, the upper cantilever member and the lower cantilever member are flexible and resilient, and form a forward opening at their forward portions immediately behind the upper bridge and lower bridge. Still further, the upper and lower bridges form a forward bridge opening.

In accordance with another aspect of the invention, when the solid wire is inserted into the electrical receptacle, inner surfaces of the upper and lower bridges will provide a wiping or cleaning action with respect to a surface of the wire. Also, when the wire is inserted into the receptacle, the wire is securely seated and coupled to the terminal through the shape and sizing of the upper and lower half cylinder sections. Still further, the solid wire terminal can include a connecting beam extending rearwardly from the receptacle. A terminal input channel can extend rearwardly from the connecting beam to provide a connection area for an external wire. The terminal input channel can also include a pair of crimp wings integrally formed at lateral sides of the terminal input channel.

BRIEF DESCRIPTION OF THE DRAWINGS

The invention will now be described with respect to the drawings, in which.

DETAILED DESCRIPTION OF THE PREFERRED EMBODIMENT

The principles of the invention will now be disclosed, by way of example, in a solid wire terminal 200 as illustrated in FIGS. 10-19. The solid wire terminal 200 provides for conductive electrical contact between wires or other components attached to the solid wire terminal 200, and a conductive solid wire. The terminal 200, in accordance with the invention, provides for the advantage of electrical contact along the longitudinal axis of the solid wire, and at a continuum of locations along the solid wire. This capability of conductive electrical contact is provided without requiring any type of splicing or other similar activity which may result in discontinuity of electrical current flowing through the solid wire and/or a substantial amount of additional material content. In addition, the solid wire terminal 200 provides at least six locations of contact with respect to the electrical engagement of the terminal 200 with the conductive solid wire.

Prior to describing the solid wire terminal 200, a prior art electrical contact unit 100 will be described herein as illustrated in FIGS. 1-9. The electrical contact unit 100 is the subject of commonly owned U.S. Pat. No. 4,990,110, issued Feb. 5, 1991. Following the description of the electrical contact unit 100, the solid wire terminal 200 in accordance with the invention will be described.

The contact unit 100 as described herein provides at least six locations of contact with respect to the electrical engagement of male blade terminals with the electrical contact unit. In addition, the contact unit 100 also provides triangular positioning of contact points so as to maintain a stable electrical connection between the blade terminals and the elements of the electrical receptacles.

Figure 1:
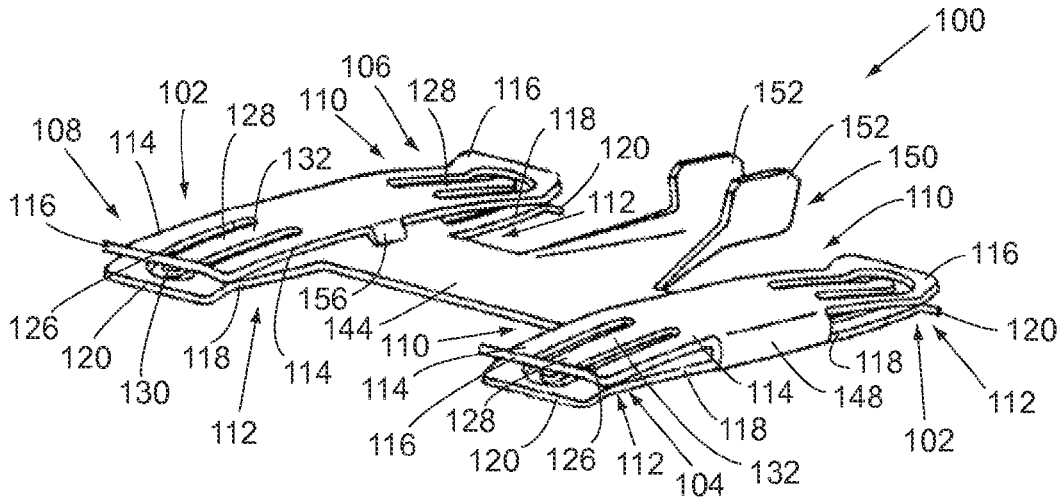
Fig. 1 (Prior Art)
FIG. 1 is a perspective view of a prior art electrical contact arrangement.

Referring primarily to FIG. 1, the electrical contact unit 100 includes a series of four electrical receptacles 102, 104, 106 and 108. As illustrated in FIGS. 1-6, each electrical receptacle 102, 104, 106 and 108 includes an outer, elongated and upper cantilever member 110, and an opposing lower cantilever member 112. The upper cantilever members 110 each include a pair of lateral and parallel elongated arms 114 integrally connected at their forward ends by a bridge portion 116. Correspondingly, each of the lower cantilever members 112 includes corresponding lateral arms 118 integrally connected at their forward ends by a lower bridge portion 120.

Figure 3:
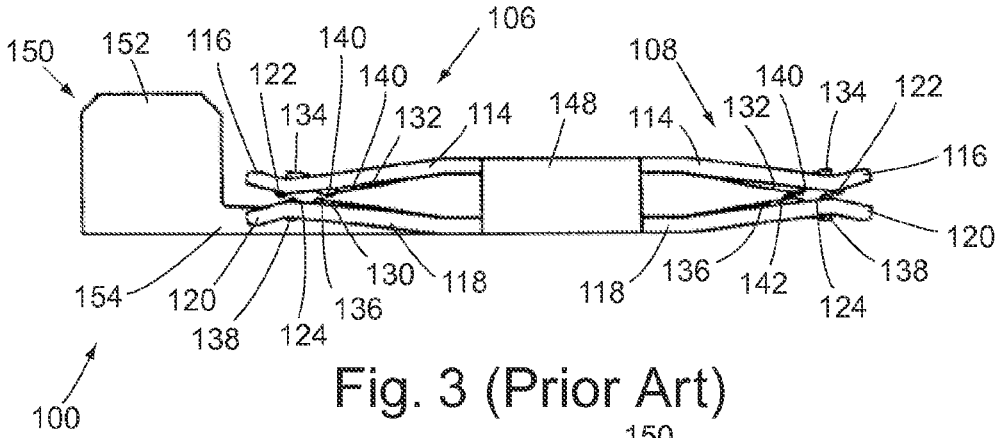
Fig. 3 (Prior Art)
FIG. 3 is a side view of the prior art contact arrangement shown in FIG. 1.
Figure 4:
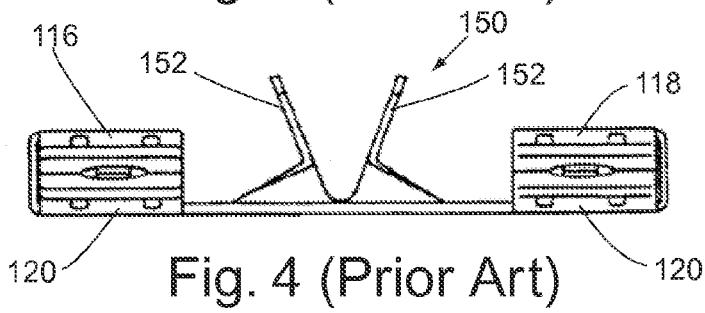
Fig. 4 (Prior Art)
FIG. 4 is an end view of the prior art contact arrangement shown in FIG. 1.
Figure 6:
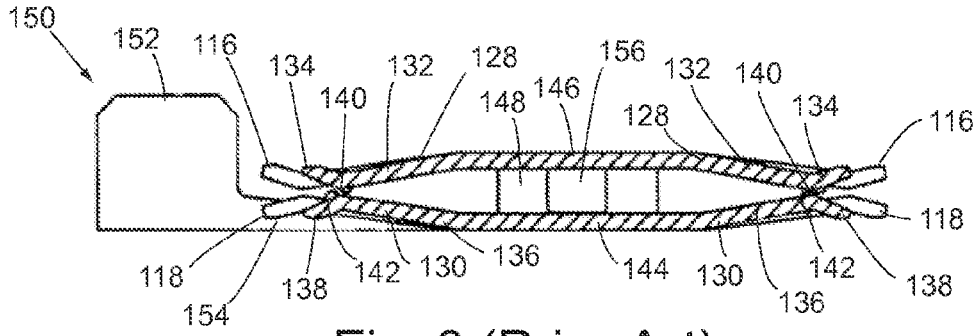
Fig. 6 (Prior Art)
FIG. 6 is a sectional view of the prior art contact arrangement shown in FIG. 2, and taken along section lines 6-6 of FIG. 2.

As illustrated primarily in FIGS. 3 and 6, the upper lateral arms 114 have a slight downwardly angled configuration, while the upper bridge portion 116 is angled slightly upwardly. With this configuration, a contact surface or edge 122 is formed at the integral interface between the upper bridge portion 116 and each of the lateral arms 114. Correspondingly, the lateral arms 118 of the lower cantilever members 112, as further illustrated in FIGS. 3 and 6, are angled slightly upwardly, while the lower bridge portion 120 is angled slightly downwardly. With this configuration, a contact surface or edge 124 is provided at the interface between the integrally connected lateral arms 118 and lower bridge portion 120.

Figure 2:
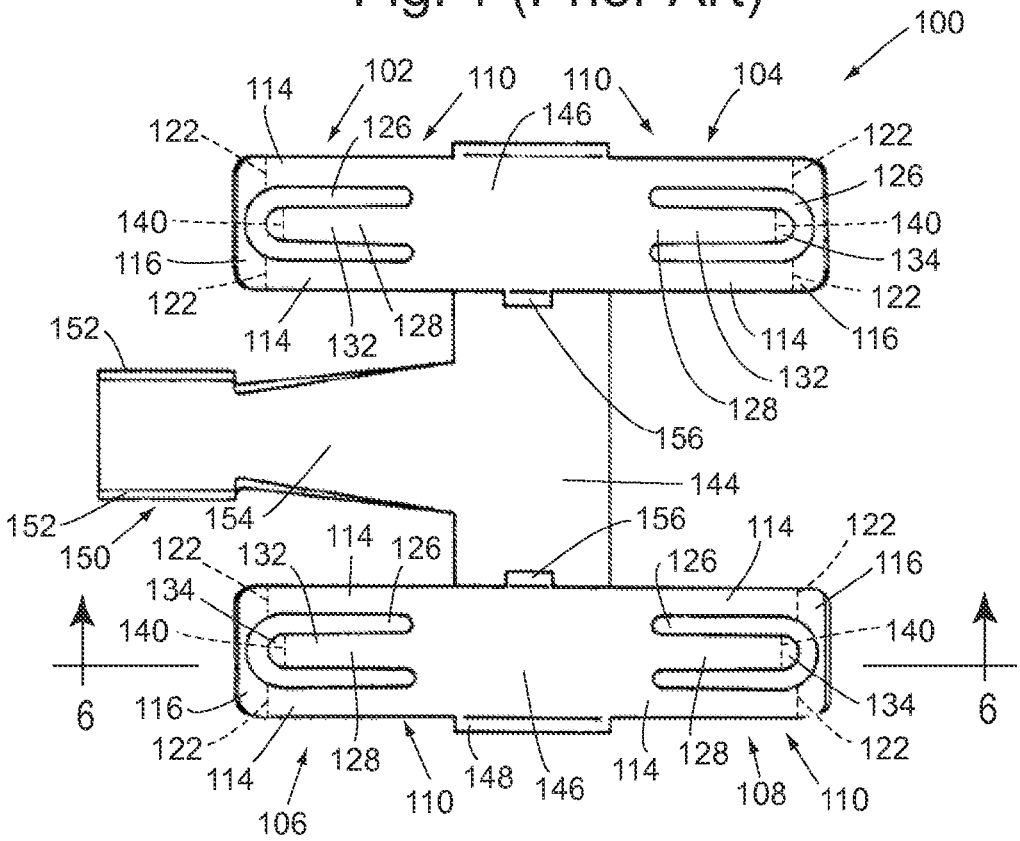
Fig. 2 (Prior Art)
FIG. 2 is a top plan view of the prior art contact arrangement shown in FIG. 1.
Figure 5:
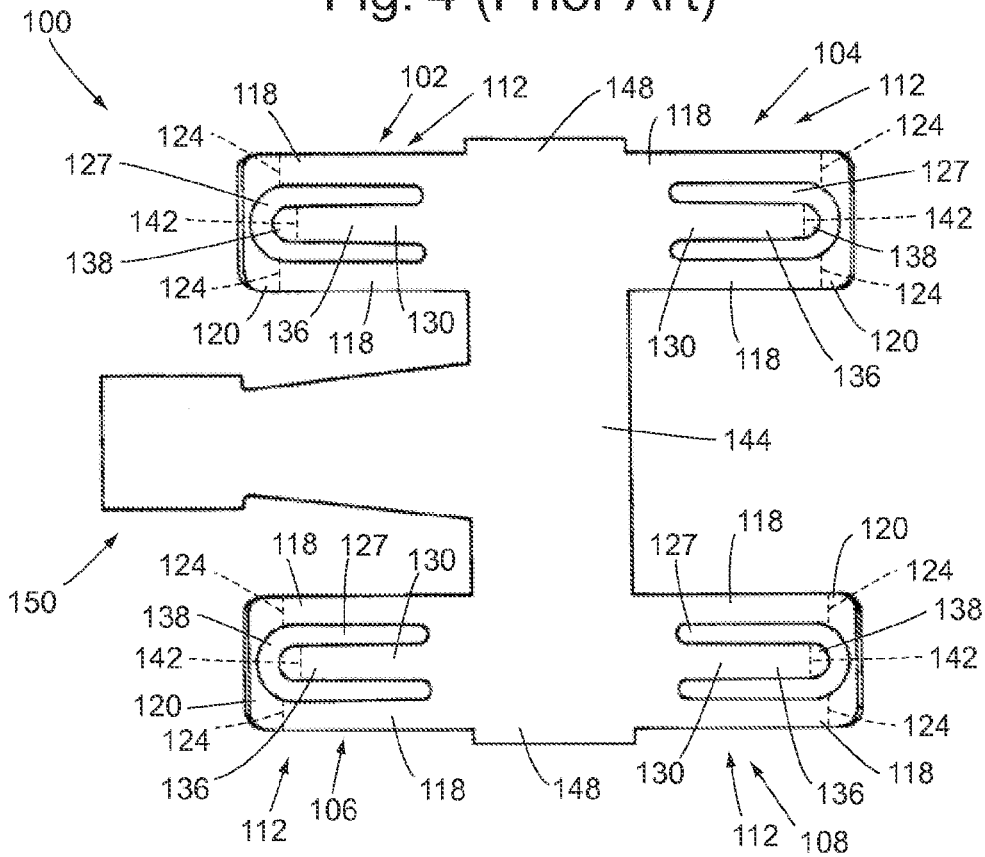
Fig. 5 (Prior Art)
FIG. 5 is an underside view from the opposing side of the prior art contact arrangement shown in FIG. 2.

As shown primarily in FIGS. 2 and 5, the lateral arms 110 and bridge portion 116 of the upper cantilever members 110 form an arcuate spatial area 126 internal to the arms 114 and bridge portion 116. A similar spatial area 127 is formed by the lateral arms 118 and lower bridge portion 120 of the lower cantilever members 112. With respect specifically to FIG. 2, each of the receptacles 102, 104, 106 and 108 also include an inner and upper cantilever member 128 which extends forwardly within the spatial area 126 formed by the lateral arms 114 and bridge portion 116. An opposing inner cantilever member 130 is formed within the corresponding spatial area 127 of the lower cantilever members 112 and also extends forwardly. As illustrated primarily in FIGS. 3 and 6, each of the upper cantilever members 128 is resilient in structure and has a rear downwardly angled portion 132 integrally connected at the forward portion thereof to a forward upwardly angled portion 134. Correspondingly, each of the lower and inner cantilever members 130 includes a rear upwardly angled portion 136 integrally connected at its forward end to a forward downwardly angled portion 138. The interface between the rear downwardly angled portion 132 and forward upwardly angled portion 134 of the upper cantilever member 128 forms a contact surface or edge 140. Correspondingly, a contact surface or edge 142 is formed at the interface between the integrally connected rear upwardly angled portion 136 and forward downwardly angled portion 138 of the lower cantilever members 130.

The opposing upper and lower cantilever members 110, 112 and the opposing inner cantilever members 128, 130 are flexible and resilient in nature so as to be appropriately flexed when a male blade terminal (illustrated in FIGS. 7-9) is inserted between the opposing cantilever members. In addition, the contact surfaces 122 and 140 associated with the upper cantilever member 110 and the upper cantilever member 128 form a triangular contact surface configuration with the male blade terminal. Correspondingly, the contact surfaces 124 and 142 form an opposing triangular contact surface configuration, thereby providing six points of contact between the electrical receptacles 102, 104, 106 and 108 and the inserted male blade terminal. This triangular configuration provides a substantial stabilizing effect to the interconnection between the male blade terminal and the electrical receptacles, while correspondingly providing six points of contact. Referring again primarily to FIGS. 1, 2 and 5, the four-receptacle unit 100 includes a connecting beam 144 central to and symmetrically located relative to the receptacles 102, 104, 106 and 108. The connecting beam 144 is rectangular in configuration and is integrally connected to each of two secondary connecting portions 146 by means of a U-shaped connecting portion formed at each of the ends of the connecting beam 144. Each of the secondary connecting portions 146 also forms an integral inner support portion for the upper cantilever members 110 and the upper cantilever members 128.

As further illustrated in FIGS. 1, 2 and 5, the four-receptacle unit 100 includes a common terminal input channel 150 having a pair of crimp wings 152 integrally formed at the lateral sides of the channel 150. The channel 150 includes a transition portion 154 integrally connecting the common terminal input channel 150 with the connecting beam 144. In addition to the foregoing, the receptacle unit 100 also includes a pair of tabs 156 each formed on one side of each of the secondary connecting portions 146. These tabs 156 provide a means for controlling positioning of the "boxes" formed by the surfaces of the connecting beam 144, secondary connecting portions 146 and U-shaped connecting portions 148.

Figure 7:
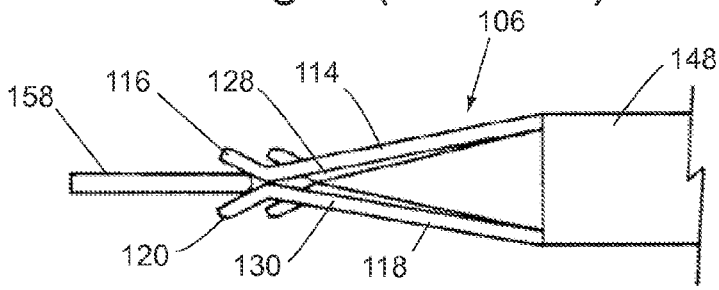
Fig. 7 (Prior Art)
FIG. 7 is a side view of the prior art contact arrangement shown in FIG. 2, and further showing an example insertion arrangement of a blade terminal into the contact arrangement.
Figure 8:
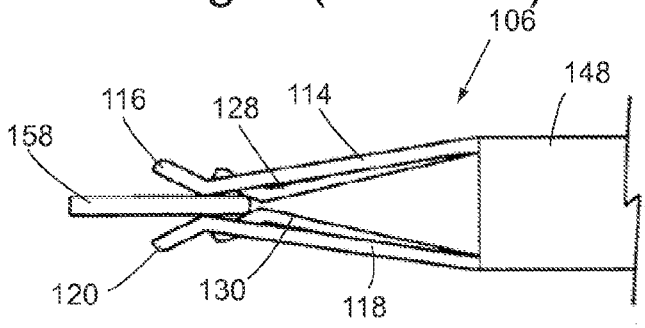
Fig. 8 (Prior Art)
FIG. 8 is an illustration similar to FIG. 7, showing further insertion of the blade terminal.
Figure 9:
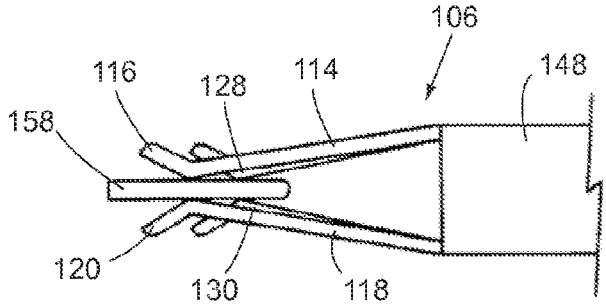
Fig. 9 (Prior Art)
FIG. 9 is an illustration similar to FIG. 8, showing a final position insertion of the blade terminal.

The use of the electrical contact unit 100 with corresponding insertion of a male blade terminal 158 will now be described with respect to FIGS. 7-9. The male blade terminal or tab contact 158 may, as illustrated in FIGS. 7, 8 and 9, include tapered surfaces at its forward portion for purposes of facilitating insertion into the electrical receptacles 102, 104, 106 and 108. For purposes of illustration, FIGS. 7, 8 and 9 only illustrate one of the electrical receptacles 106. The forward portion of the blade terminal 158 is first inserted into the spatial area formed between the upper bridge portion 116 and lower bridge portion 120. As the blade terminal 158 is inserted, upper and lower surfaces of the terminal 158 will contact the upper contact surfaces 122 and lower contact surfaces 124 formed at the interface between the bridge portions 116, 118 and the lateral arms 114, 118. As the blade terminal 158 is further inserted, the forward portion of the terminal 158, at its upper and lower surfaces near the central portions thereof, will engage in an electrical contact with the contact surfaces 140, 142 formed at the interfaces of the integrally connected downwardly angled portion 132 and forwardly and upwardly angled portion 134 of the upper cantilever member 128, and the interface between the integrally connected upwardly angled portion 136 and downwardly angled portion 138.

As previously described, the upper contact surfaces 122 and 140 provide a triangular configuration, with three locations of electrical contact. This triangular configuration provides a substantial stabilizing effect which prevents relatively poor contact if the interconnection between the male blade terminal 158 and the corresponding receptacle is jarred or otherwise subjected to a "rocking" movement. Correspondingly, the three locations of lower contact provided by the contact surfaces 124 and 142 provide a corresponding triangular contact surface configuration opposing the upper contact configuration. With the three points of lower contact, the interconnection and engagement between the male blade terminal 158 and the corresponding electrical receptacle is provided with six locations of contact. Still further, if the male blade terminal 158 is appropriately sized relative to the relative positioning of the bridge portions 116, 120, the surfaces of the bridge portions 116, 120 will provide a "wiping" engagement with the central portion of the upper and lower surfaces of the blade terminal 158. This wiping engagement will ensure that the central portion of the blade terminal 158 which will be in electrical contact with the upper and inner cantilever member 128 and lower and inner cantilever member 130 will be free from any foreign matter as a result of the "cleaning" function carried out by the bridge portions 116, 118. With the six locations of contact provided for each of the electrical receptacles 102, 104, 106 and 108, the electrical, current-carrying capability of the receptacles is greatly improved. In addition, with respect to the particular four-receptacle unit 100 illustrated herein, four receptacles are provided with the necessity of only a single wire crimp configuration in an integral terminal, thereby providing an efficient use of space within a connector system. Still further, the triangular positioning of the three locations of contact on each of the upper and lower surfaces of the male blade terminal provide a substantially "steady platform for the male blade terminal 158.

As apparent from the foregoing, the electrical connector unit 100 can be formed from a suitable metal sheet by means of stamping and forming the unit 100, with the sheet having the appropriate conductive and spring and resiliency characteristics. Such a stamping process can be achieved by utilizing a suitably formed metal sheet, and then folding over the elements forming the upper cantilever members 110 and the secondary connecting portions 146.

The embodiment of the invention in the form of the solid wire terminal 200 will now be described with respect to FIGS. 10-19. As earlier described, the solid wire terminal 200 provides at least six locations of contact with respect to the electrical engagement of a conductive solid wire with the terminal 200. In addition, the terminal 200 provides positioning of contact points so as to maintain a stable electrical connection between the terminal 200 and the conductive solid wire. Further, the terminal 200 provides for the advantage of electrical contact along the longitudinal axis of the solid wire, and at a continuum of locations along the solid wire, as desired by the user. This capability of conductive electrical contact is provided without requiring any type of splicing or other similar activity which may result in discontinuity of electrical current flowing through the solid wire and/or a substantial amount of additional material content.

Referring first primarily to FIGS. 10-17, the solid wire terminal 200 includes an electrical receptacle 202. The electrical receptacle 202 is adapted to provide for the conductive contact between the terminal 200 and a conductive solid wire. As shown primarily in FIGS. 10, 13 and 15, the electrical receptacle 202 includes an upper cantilever member 204 having an elongated configuration, and a lower cantilever member 206 having an opposing and elongated configuration. The lower cantilever member 206 is primarily shown in FIGS. 10, 11 and 13.

Figure 15:
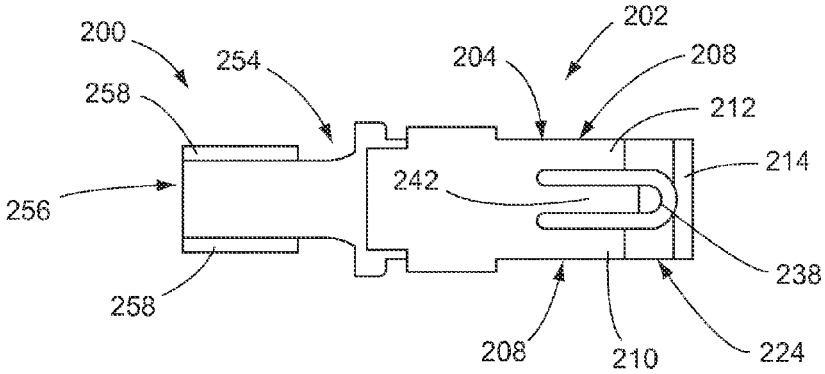
FIG. 15 is a plan view of the terminal shown in FIG. 10.
Figure 16:
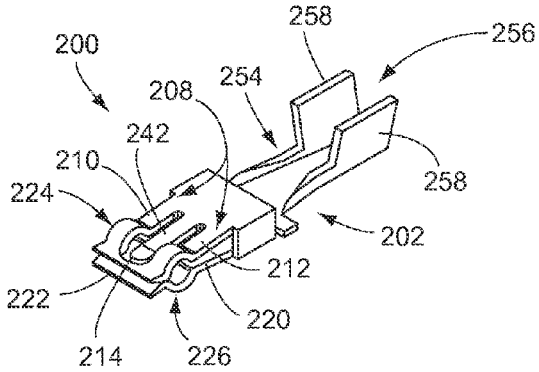
FIG. 16 is a front, perspective view of the solid wire terminal shown in FIG. 10.
Figure 17:
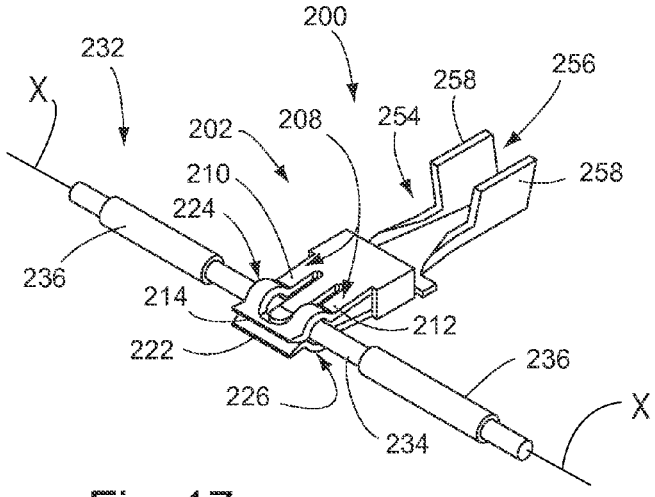
FIG. 17 is a front, perspective view of the solid wire terminal shown in FIG. 10, with the view being substantially identical the view in FIG. 16, but further showing the solid wire terminal as being releasably and conductively attached to a solid conductive wire.

The upper cantilever member 204 includes a pair of lateral and parallel elongated upper arms 208, primarily shown in FIGS. 15, 16 and 17. The elongated upper arms 208 include a first upper arm 210 and a laterally opposing second upper arm 212. Each of the upper arms 210, 212 are primarily illustrated in FIGS. 15, 16 and 17. The upper arms 210, 212 are integrally connected at their forward ends by an upper bridge, also shown in FIGS. 15, 16 and 17. Correspondingly, the lower cantilever member 206 includes a pair of lateral and parallel elongated lower arms 216. The lower arms 216 are primarily shown in FIG. 11, and include a first lower arm 218 and a second lateral opposing lower arm 220. The first and second lower arms 218, 220, respectively can be integrally connected at their forward ends by a lower bridge 222. The lower bridge 222 is primarily shown in FIGS. 11, 16 and 17.

With respect to the upper arms 210, 212, each arm includes an upper arm half cylinder section 224, as primarily shown in FIGS. 10, 15, 16 and 17. The upper arm half cylinder sections 224 have a curved or arcuate shape with a downwardly facing concave configuration. Correspondingly, and as shown in FIGS. 10, 11, 16 and 17, each of the lower arms 218, 220 include a lower arm half cylinder section 226. Each of the lower arm half cylinder sections 226 has a curved or arcuate configuration directly and vertically opposing corresponding ones of the upper arm half cylinder sections 224. The lower arm half cylinder sections 226 have an upwardly facing concave configuration.

Figure 10:
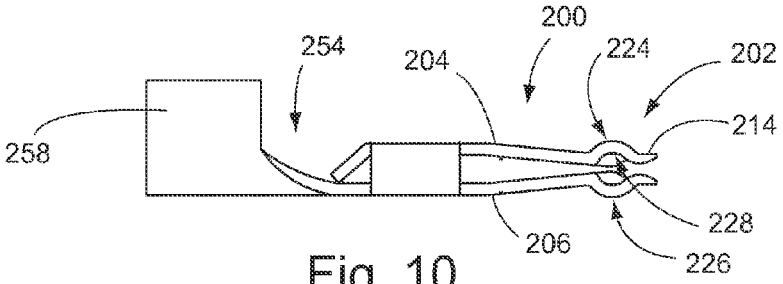
FIG. 10 is a side, elevation view of a solid wire terminal in accordance with the invention.
Figure 11:
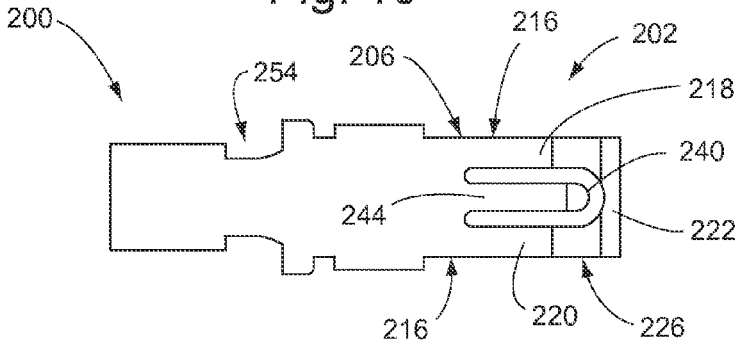
FIG. 11 is an underside view of the solid wire terminal shown in FIG. 10.
Figure 12:
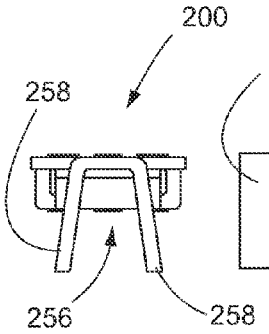
FIG. 12 is a rear view of the solid wire terminal shown in FIG. 10, but showing the terminal in an "upside down" configuration.
Figure 13:
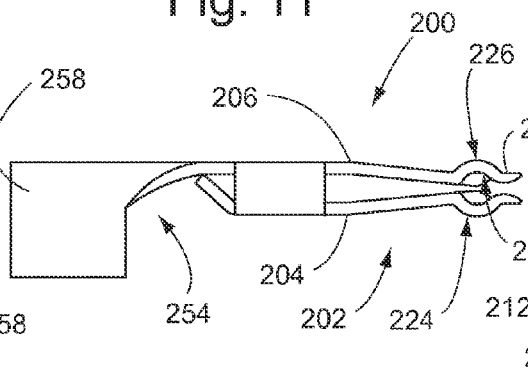
FIG. 13 is a side, elevation view of the terminal shown in FIG. 10, but showing the terminal in an "upside down" configuration.
Figure 14:
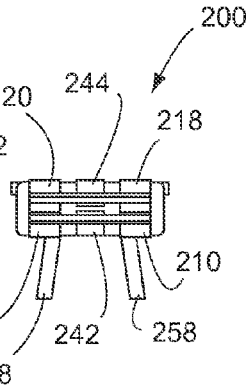
FIG. 14 is a front view of the terminal shown in FIG. 10, but showing the terminal in an "upside down" configuration.

As illustrated primarily in FIGS. 10 and 13, each of the upper arms 210, 212 have a slight downwardly angled configuration, while the lower arms 218, 220 of the receptacle 202 are angled slightly upwardly. The upper arms 210, 212 and the lower arms 218, 220 are flexible and resilient in nature so as to be appropriately flexed when a conductive solid wire is inserted between the upper cantilever member 204 and the lower cantilever member 206.

The upper arm half cylinder sections 224 can be characterized as having inner surfaces 228. The numerical reference 228 is shown in FIG. 10. Correspondingly, the lower arm half cylinder sections 226 can be characterized as having inner surfaces 230. The numerical reference 230 is shown in FIG. 13.

The opposing upper arm half cylinder sections 224 and lower arm half cylinder sections 226 are sized and configured, and sufficiently flexible and resilient in nature, so as to be appropriately flexed when a conductive solid wire 232 is releasably received or inserted between the opposing cylinder sections 224, 226. The conductive solid wire 232 is expressly illustrated in FIGS. 17, 18 and 19. As shown in particular in FIG. 17, the conductive wire 232 can include a solid wire section 234 through which current may flow. For protective and insulated purposes, the solid wire terminal 232 may include sheathing 236. The solid wire section 234 may be constructed of any suitable conductive material, such as copper or the like. The sheathing 236 may be constructed of any appropriate insulative material. As shown in particular in FIGS. 17 and 19, the conductive solid wire 232 can be conductively captured within the opposing half cylinder sections 224, 226, in a manner so that electrical current can flow between the solid wire terminal 200 and the conductive solid wire terminal 232.

As shown primarily in FIG. 15, the lateral and parallel elongated upper arms 208 and upper bridge 214 form an arcuate spatial area 238 internal to the upper arms 208 and upper bridge 214. A similar lower arcuate spatial area 240 is formed by the lateral and parallel elongated lower arms 216 and lower bridge 222 of the lower cantilever member 206. This spatial area 240 is expressly shown in FIG. 11. The electrical receptacle 202 also includes an inner and upper cantilever member 242, which extends forwardly within the upper arcuate spatial area 238. This cantilever member 242 is shown in FIGS. 15-19. Correspondingly, an opposing inner and lower cantilever member 244 is formed within the corresponding lower arcuate spatial area 240, and also extends forwardly. The inner and lower cantilever member 244 is illustrated in FIGS. 11 and 16-19.

Figure 18:
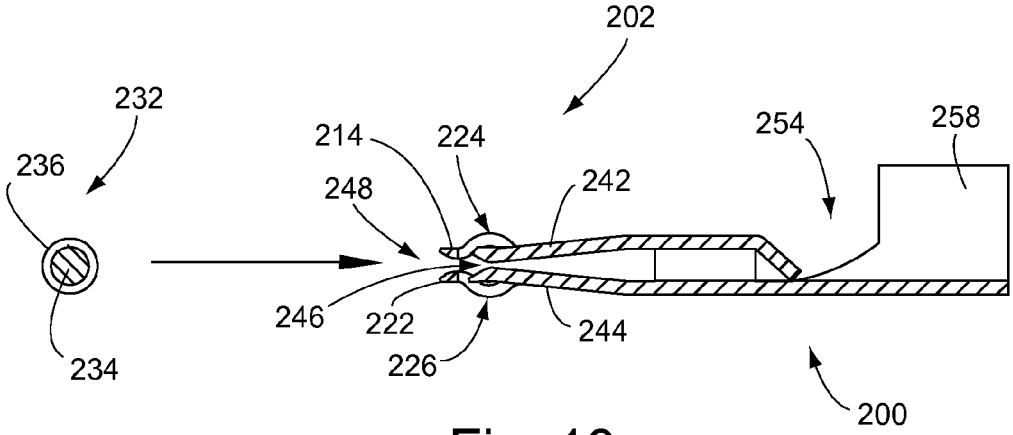
FIG. 18 is a side, sectional view of the solid wire terminal shown in FIG. 16, and further showing a sectional view of the solid wire terminal shown in FIG. 17, and taken along lines 18-18 of FIG. 15, and further showing a sectional view of the conductive solid wire shown in FIG. 17, but showing the conductive solid wire in a spatial position adjacent the solid wire terminal, and specifically positioned for initial engagement with the solid wire terminal.
Figure 19:
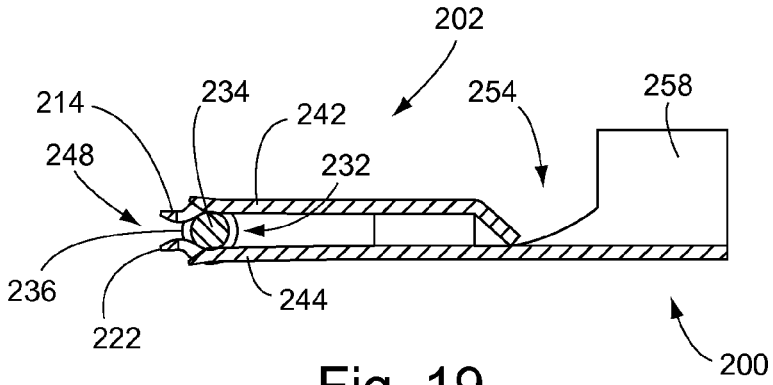
FIG. 19 is a side, sectional view of the solid wire terminal and the solid wire shown in FIG. 17, and taken along lines 19-19 of FIG. 17.

As primarily shown with respect to FIGS. 18 and 19, where the upper cantilever member 242 and lower cantilever member 244 are shown in sectional view and in relationship to the conductive solid wire 232, the upper cantilever member 242 and the lower cantilever member 244 are flexible and resilient in structure and form a forward opening 246 at their forward portions immediately behind the upper bridge 214 and lower bridge 222. Correspondingly, the upper bridge 214 and lower bridge 222 can also be characterized as forming a forward bridge opening 248. With the sizing, configuration and flexible resiliency of the cantilever members 242, 244, the conductive solid wire 232 can be positioned as shown in FIG. 18, and then inserted and received within the forward opening 246 between the cantilever members 242, 244, and also within the forward bridge opening 248 formed between the upper bridge 214 and the lower bridge 222. Still further, with the configuration of the cantilever members 242, 244, and when the conductive solid wire 232 is received within the forward opening 246, an upper contact surface or edge 250 is formed at the interface between the upper bridge 224 and the conductive surface of the solid wire section 234. Correspondingly, a lower contact surface or edge 252 is formed at the interface between the lower bridge 222 and the exterior conductive surface of the solid wire section 234 when the conductive solid wire 232 is received within the electrical receptacle 202. The numerical references 250, 252 for these contact surfaces are shown in FIGS. 18 and 19.

In accordance with the foregoing, the electrical receptacle 202 provides for six contact surfaces or edges which form conductive areas of contact between the solid wire terminal 200 and the solid wire section 234 of the conductive solid wire 232. Further, it should be noted that in accordance with certain aspects of the invention, the flexibility and resilience of the cylindrical sections 224, 226 and the cantilever members 242, 244 operate somewhat independently of each other. With this capability of independent flexibility, higher quality contact can be made between the surfaces of each of these components and the surface of the solid wire section 234. Further, with this somewhat independent flexibility, relatively small imperfections in the smoothness of the external surface area of the solid wire section 234 will not substantially lessen the quality of the conductive contacts between the electrical receptacles 202 and the solid wire section 234.

In addition to the foregoing components, and with reference to essentially all of FIGS. 10-19, the solid wire terminal 200 includes a connecting beam 254 extending rearwardly from the electrical receptacle 202. Extending rearwardly from the connecting beam 254 is a terminal input channel 256, as primarily shown in FIGS. 15, 16 and 17. The terminal input channel 256 provides a connection area for an external wire or similar electrical component. The terminal input channel 256 includes a pair of crimp wings 258 integrally formed at the lateral sides of the terminal input channel 256. At least one of the crimp wings 258 is shown in FIGS. 10 and 12-19.

The use of the solid wire terminal 200 with corresponding insertion and conductive connection to the conductive solid wire 232 will now be described primarily with respect to FIGS. 17, 18 and 19. The conductive solid wire 232 may include a cylindrical or circular solid wire section 234. Advantageously, and in accordance with certain aspects of the invention, the solid wire terminal 200 can be connected to the conductive solid wire 232 in a configuration where the solid wire terminal 200 extends away from the solid wire section 234 in a perpendicular relationship, relative to a longitudinal axis X (shown in FIG. 17) of the conductive solid wire 232. As the conductive solid wire 232 is moved from its position shown in FIG. 18 to an insertion position as shown in FIG. 19, the outer surface of the solid wire section 234 will first contact inner surfaces of the upper bridge 214 and lower bridge 222. Advantageously, this contact with the surface of the solid wire section 234 will provide somewhat of a "wiping" or cleaning action with respect to the surface of the solid wire section 234, thereby providing for a better and higher quality conductive contact between the terminal 200 and the conductive solid wire 232.

As the solid wire section 234 is further inserted into the forward bridge opening 248, the opposing upper and lower bridges 214, 222, respectively, are flexed in opposing directions and the solid wire section 234 is "seated" within the area formed between the upper arm half cylinder sections 224 and the lower arm half cylinder sections 226. These surfaces which contact the solid wire section 234 have been previously referred to herein as the upper arm half cylinder section inner surfaces 228 (FIG. 10) and the lower arm half cylinder sections inner surfaces 230 (FIG. 13). In addition, as the solid wire section 234 is being seated between the half cylinder sections 224, 226, the solid wire section 234 contacts the upper contact surface or edge 250 of the upper bridge 214 and lower contact surface or edge 252 of the lower bridge 222, as the solid wire terminal 234 is received through the forward opening 246. These contact surfaces 250, 252 provide two additional conductive contacts between the solid wire section 234 and the solid wire terminal 200. Also, the conductive solid wire 232 is securely seated and coupled to the solid wire terminal 200 through the shape and sizing of the half cylinder sections 224, 226.

As previously described, the contact surfaces 228, 230 of the half cylinder sections 224, 226, and the contact surfaces 250, 252 of the cantilever members 242, 244, respectively provide a contact configuration with six locations of electrical contact. Further, the relative geometric configuration of the contact surfaces and the configuration of the half cylinder sections 224, 226 provide a substantial stabilizing effect which prevents relatively poor contact if the interconnection between the conductive solid wire 232 and the electrical receptacle 200 is jarred or otherwise subjected to a "rocking" movement. Further, the three locations of upper contact provide a particular geometric contact surface configuration opposing the lower contact configuration. These configurations provide greater stability to the conductive contacts between the electrical receptacles 202 and the conductive solid wire 232.

In addition, the surfaces of the upper bridge 214 and lower bridge 222 can provide a "wiping" effect or engagement with the exterior surface of the solid wire section 234 as the conductive solid wire 232 is being inserted into the electrical receptacle 202. This wiping engagement provides relatively greater assurance that the solid wire section 234 which is an electrical contact with the cantilever members 204, 206 will be free from any foreign matter as a result of the "cleaning" function carried out by the bridges 214, 222. Further, with the six locations of contact provided by the electrical receptacle 202, the electrical, current-carrying capability of the receptacle 202 is greatly improved.

Also, and as previously described herein, the solid wire terminal 200 in accordance with the invention provides for the capability of a conductive electrical connection along a continuum of locations of a conductive solid wire. This capability is provided without any requirement of splicing or other "cutting off" of solid wire continuity, for purposes of engaging a terminal along the longitudinal axis of the wire. Such prior requirements for splicing or similar activities lessen the quality and integrity of the electrical conductivity through the solid wire, particularly at connection junctions between the solid wire and terminal elements. Further, such splicing and similar activities often require the use of electrical terminals having a substantial metallic content, and can therefore add substantial expense with respect to labor for assembly and material content.

Figure 17A:
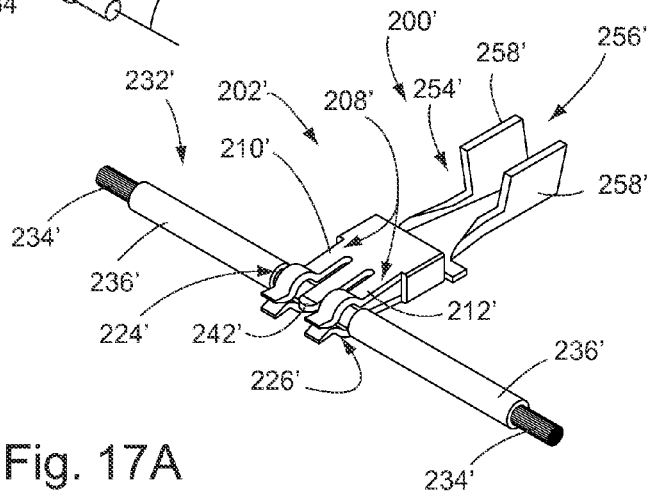
FIG. 17A is a front, perspective view of a wire terminal substantially similar to the terminal shown in FIG. 17, but showing the wire terminal as being releasably and conductively attached to a stranded wire.
Figure 20:
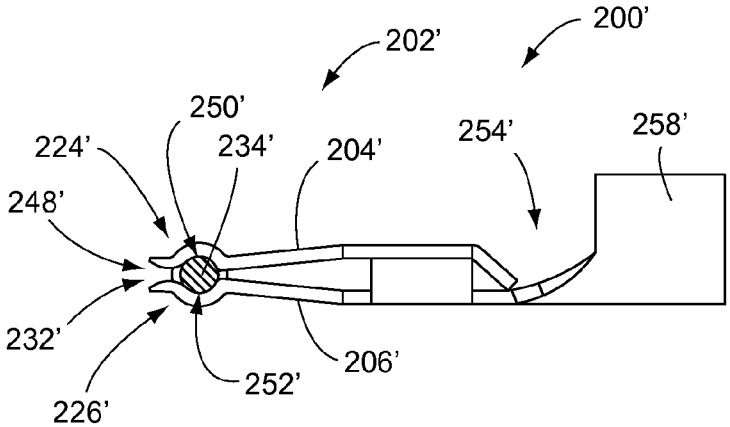
FIG. 20 is a side view of a wire terminal in accordance with the invention, and showing the wire terminal being used with a wire in the form of a stranded wire.

In addition to the use of the wire terminal 200 with the conductive solid wire 232, it will be appreciated that such wire terminals can also be utilized with a stranded wire. For example, and with reference to FIGS. 17A and 20, another wire terminal 200' is shown which is substantially similar to solid wire terminal 200, such that the various components and features of wire terminal 200' will generally be understood with reference to the above descriptions, the reference numbers of solid wire terminal 200' generally corresponding to like components of terminal 200. However, wire terminal 200' lacks upper and lower bridges joining distal ends of the respective upper arms 210', 212' and the corresponding lower arms. Thus, upper arms 210', 212' and an upper cantilever member 242' form three separate cantilevered members along one side of a conductive wire 232', which is shown as a stranded wire in FIGS. 17A and 20, while the lower arms also form separate cantilevered members along an opposite side of the conductive wire 232' when coupled thereto.

It will be apparent to those skilled in the pertinent arts that other embodiments of electrical terminals in accordance with the invention can be achieved. That is, the principles of an electrical terminal in accordance with the invention are not limited to the specific embodiment described herein. It will be apparent to those skilled in the art that modifications and other variations of the above-described illustrative embodiment of the invention may be effected without departing from the spirit and scope of the novel concepts of the invention.

The embodiments of the invention in which an exclusive property or privilege is claimed or defined as follows:

1. A wire terminal comprising:

an upper portion extending forwardly, and having surfaces with at least three upper contact locations formed thereon;

lower portion extending forwardly and conductively interconnected to and positioned substantially directly below said upper portion, and having upwardly directed surfaces with at least three lower contact locations formed thereon;

wherein said upper and lower portions are sized and configured so that a conductive wire is insertable between said upper portion and said lower portion, whereby the conductive wire is conductively contacted by said at least three upper contact locations of said upper portion and by said at least three lower contact locations of said lower portion, so as to form at least six conductive electrical contact locations with said terminal; and said upper portion further comprises:

a pair of lateral and parallel elongated upper arms extending forwardly, said upper lateral arms comprising a first upper arm and a second upper arm;

an upper bridge positioned transversely across forward portions of said lateral and parallel elongated upper arms; and each of said lateral and parallel elongated upper arms comprises an upper arm half cylinder section having a curved shape with a downwardly facing concave configuration.

2. A wire terminal in accordance with claim 1, characterized in that:

said upper bridge and said lateral and parallel elongated upper arms form an upper arcuate spatial area; and said upper portion further comprises an inner and upper cantilever member positioned substantially within said upper arcuate spatial area and having a shape forming a first upper contact location comprising a contact surface thereon.

3. A wire terminal in accordance with claim 2, characterized in that:

each of said upper arm half cylinder sections comprises an upper arm half cylinder section inner surface; and when the conductive wire is inserted between said upper and lower portions, said upper arm half cylinder section inner surfaces form second and third upper contact locations between said upper arm half cylinder sections and the conductive wire.

4. A wire terminal in accordance with claim 1, characterized in that said lower portion comprises:

a pair of lateral and parallel elongated lower arms extending forwardly; and a lower bridge positioned transversely across forward portions of said lateral and parallel elongated lower arms.

5. A wire terminal in accordance with claim 4, characterized in that:

said lateral and parallel elongated lower arms and said lower bridge form a lower arcuate spatial area; and said lower portion further comprises an inner and lower cantilever member positioned substantially within said lower arcuate spatial area and having a shape forming a first lower contact location comprising a contact surface thereon between said inner and lower cantilever member and the conductive wire.

6. A wire terminal in accordance with claim 5, characterized in that each of said lateral and parallel elongated lower arms comprises a lower arm half cylinder section with a curved configuration directly opposing corresponding ones of said upper arm half cylinder sections, and with said lower arm half cylinder sections having upwardly facing concave configurations.

7. A wire terminal in accordance with claim 6, characterized in that:

each of said lower arm half cylinder sections comprises a lower arm half cylinder section inner surface; and when the conductive wire is received between said upper and lower portions, said lower arm half cylinder section inner surfaces provide second and third contact locations between said lower arm half cylinder sections and the conductive wire.

8. A wire terminal in accordance with claim 7, characterized in that each of said first, second and third lower contact locations is respectfully positioned substantially directly below each of said first, second and third upper contact locations.

9. A wire terminal in accordance with claim 8, characterized in that said upper arm half cylinder sections and said lower arm half cylinder sections are sized and configured, and sufficiently flexible and resilient, so as to be appropriately flexed when the conductive wire is releasably received or inserted between said upper arm half cylinder sections and said lower arm half cylinder sections.

10. A wire terminal in accordance with claim 9, characterized in that said upper cantilever member and said lower cantilever member are flexible and resilient in structure, and form a forward opening at their forward portions immediately behind said upper bridge and said lower bridge.

11. A wire terminal in accordance with claim 10, characterized in that said upper bridge and said lower bridge form a forward bridge opening.

12. A wire terminal in accordance with claim 11, characterized in that when the conductive wire is inserted between said upper and lower portions, contact of the conductive wire will first occur with inner surfaces of said upper bridge and said lower bridge, and such contact will provide a wiping or cleaning action with respect to a surface of the conductive wire, thereby providing for a relatively higher quality conductive contact between said wire terminal and the conductive wire.

13. A wire terminal in accordance with claim 12, characterized in that when the conductive wire is inserted between said upper and lower portions, the conductive wire is securely seated and coupled to said wire terminal through the shape and sizing of said upper arm half cylinder sections and said lower arm half cylinder sections.

14. A wire terminal in accordance with claim 13, characterized in that said wire terminal further comprises:

a connecting beam extending rearwardly from at least one of said upper and lower portions;

a terminal input channel extending rearwardly from said connecting beam for providing a connection area for an external wire or similar component; and said terminal input channel comprises a pair of crimp wings integrally formed at lateral sides of said terminal input channel.

15. A wire terminal in accordance with claim 1, wherein said upper and lower portions are adapted to conductively engage a conductive solid wire.

* * * * *